United States Patent [19]

Lee

[11] Patent Number: 4,553,746

[45] Date of Patent: Nov. 19, 1985

[54] HAND EXERCISER

[75] Inventor: Valerie H. Lee, Star Route 1, Box 542, 6914 E. Continental Mnt. Dr., Cave Creek, Ariz. 85331

[73] Assignees: Valerie Holdeman Lee; William Matthias Lee; Arlene Schaffner; Donald Schaffner, all of Scottsdale, Ariz.

[21] Appl. No.: 524,565

[22] Filed: Aug. 19, 1983

[51] Int. Cl.[4] ..... A63B 21/30

[52] U.S. Cl. ..... 272/68; 73/380; 272/DIG. 4; 272/DIG. 5

[58] Field of Search ..... 272/67–68, 272/143, 130, 135–139, DIG. 4, DIG. 5; 84/465, 467–468; 73/380; D21/198; 124/37, 35 R, 35 A, 31; 128/26

[56] References Cited

U.S. PATENT DOCUMENTS

| | | | |
|---|---|---|---|
| Re. 28,845 | 6/1976 | Ratchford | 272/68 |
| 766,019 | 7/1904 | Chellis et al. | 272/68 |
| 1,010,796 | 12/1911 | Pons | 272/68 |
| 2,814,491 | 11/1957 | Proctor | 272/68 |
| 2,888,768 | 6/1959 | Taylor | 124/37 X |
| 3,357,702 | 12/1967 | Van Saders | 272/68 |
| 3,442,132 | 5/1969 | De Mare | 272/68 |
| 3,721,439 | 3/1973 | Rudolph et al. | 272/DIG. 4 X |
| 4,262,898 | 4/1981 | Lee | 272/68 |

*Primary Examiner*—Robert A. Hafer
*Assistant Examiner*—Arnold W. Kramer
*Attorney, Agent, or Firm*—Weiss & Holloway

[57] ABSTRACT

A hand exerciser includes a frame having a contoured hand grip portion and a slide mechanism supported within the frame for reciprocative movement. The slide mechanism includes a transverse finger grip which is both rotatable and angled to maximize the contact area between the palm of the hand and the finger grip. Springs are positioned between the frame and the slide mechanism to provide the resistive force necessary. The resistive force may be adjusted by a single internally threaded knob which cooperates with an externally threaded fastening element between the frame and the slide mechanism. A mechanical counter is coupled to the frame and is engaged by the slide element for the purpose of counting the number of strokes. Also provided is a pointer and scale mechanism for indicating the amount of resistive force provided by the springs.

9 Claims, 7 Drawing Figures

FIG. 1
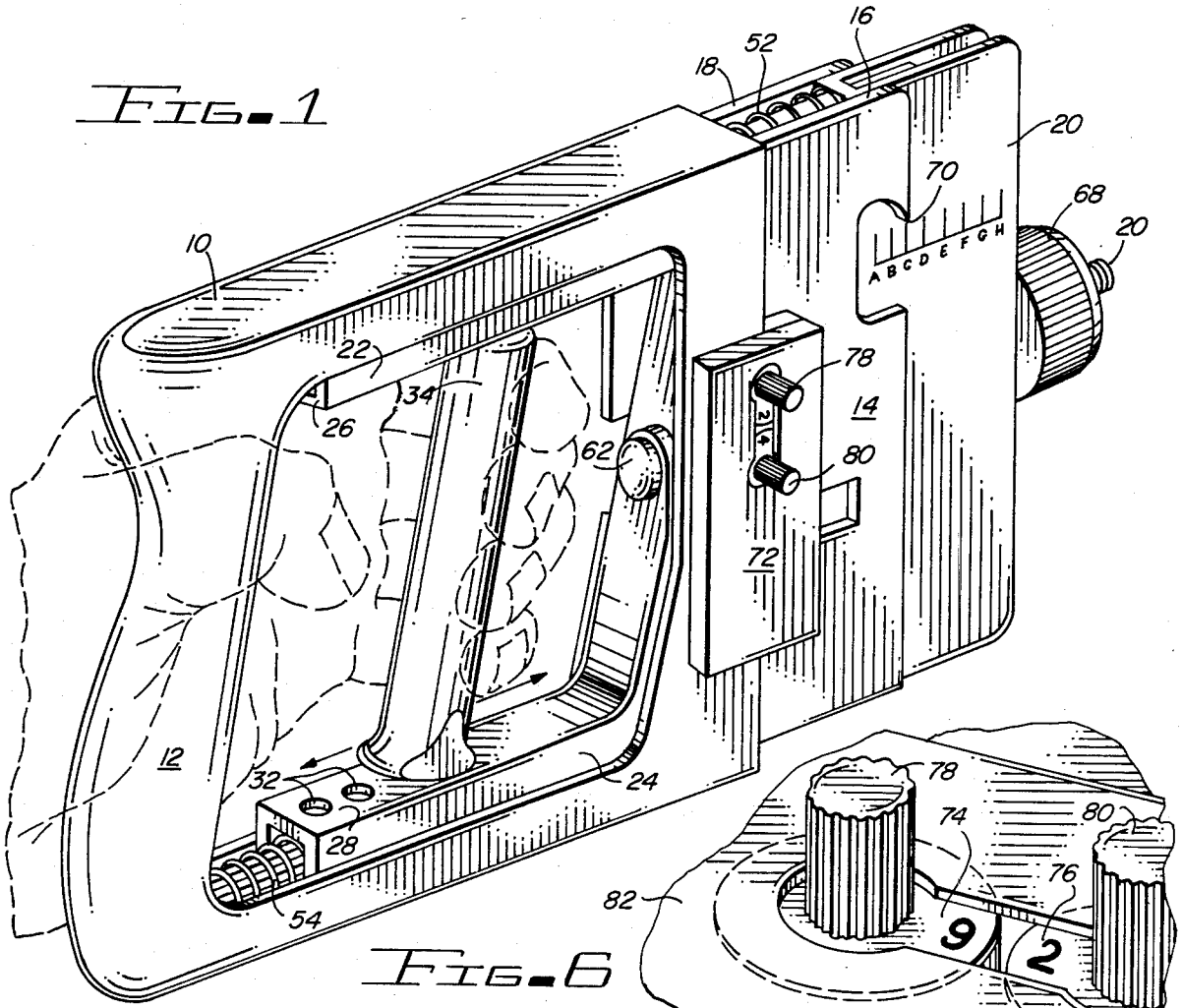
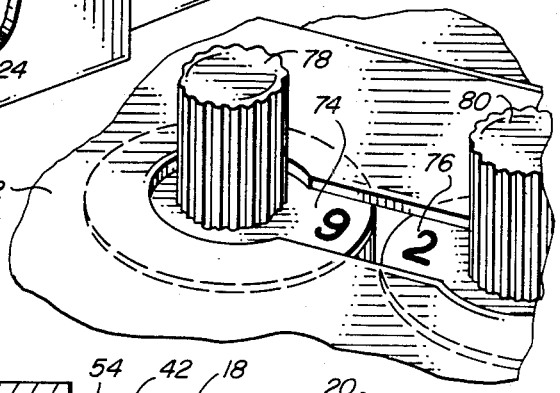
FIG. 6
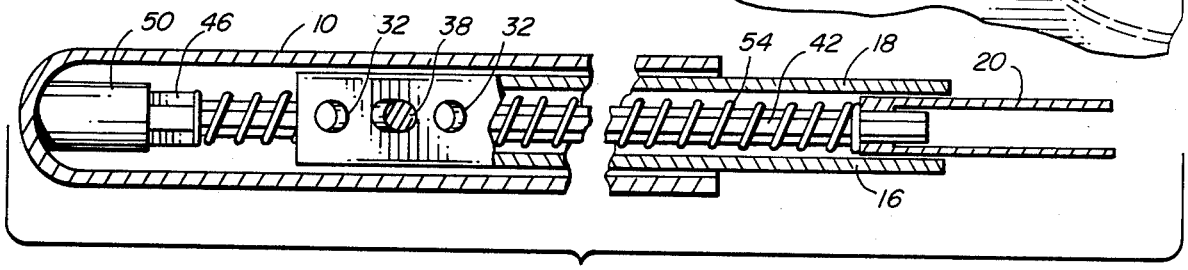
FIG. 3
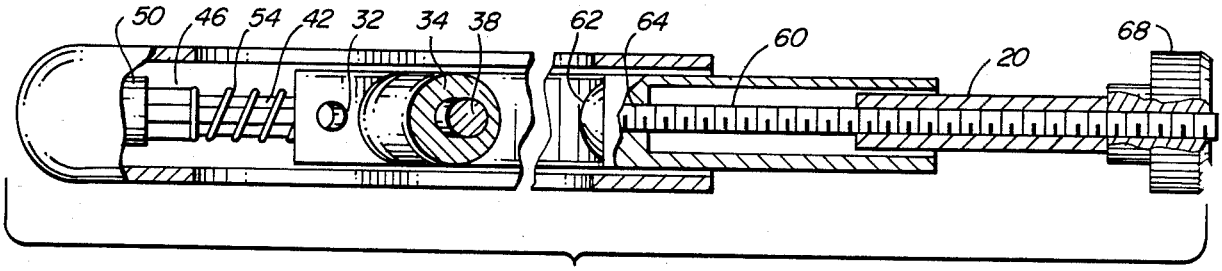
FIG. 4

HAND EXERCISER

BACKGROUND OF THE INVENTION

Field of the Invention

This invention relates generally to an apparatus for exercising the hand or fingers and, more particularly, to a hand exerciser which is anatomically, physiologically, and functionally correct. It is well known that after injury to an upper extremity, it is often necessary to immobilize the hand for a period of several days or perhaps several weeks. During this time, as a result, a patient may loose strength in the upper extremity due not only to the injury or surgery, but also due to the atrophy accompanying immobilization of the extremity. When the patient is first allowed to engage in resistive exercise, his grip strength may be less than one pound. However, much greater strength is required for the patient to be able to return to his vocational or avocational activities.

Studies of the hand have shown that a finger is fully flexed by the flexor digitorum profundus and the extensor digitorum communis. Additionally, when resistance is added, the flexor digitorum superficialis, the interossei and the intrinsics of the thumb are also activated. Therefore, by using a resistive exercising device, many muscles are forced to function. It has also been shown that the extensor digitorum communis, the flexor digitorum superficialis and the flexor digitorum profundus perform in direct proportion to the external load applied. Therefore, any hand exerciser employed should provide for increasing resistance.

Many hand exercising devices are known. Exemplary are the devices shown and described in U.S. Pat. Nos. 689,652; 756,480; 3,216,259; 3,357,702; 4,226,412; and Re. 28,845. Unfortunately, each of the devices suffers from one or more of the following disadvantages. First, the contact area between the palm of the hand and the grip of the device should be maximized in order to decrease the pressure in the thumb web space. This generally requires a contoured grip which fits along the curve of the oppositional crease, and one which is slightly convex so as to rest in the concavity of the palm formed by the transverse metacarpal arch. Many of the known devices do not include such a grip.

Second, the transverse portion of the exerciser which is actually engaged by the fingers and compressed toward the grip should be angled so as to conform to the hand. The transverse palmar axis passes along a line from the second to the fifth metacarpal heads. This forms an angle of approximately 75 degrees with the axis of the third ray. Furthermore, by angling the transverse mechanism, the fourth and fifth digits assist in initiating flexion. This is significant since the fourth and fifth digits are primarily responsible for power gripping in normal hands. Most of the known devices do not include such an angled transverse mechanism.

Third, the prior art devices do not include means for conveniently altering the stroke distance of the device so as to accommodate hands of different sizes nor do they provide a transverse mechanism which is not only angled but also rotatably mounted. The rolling feature created along with the ability to change the stroke distance of the transverse mechanism provides for complete flexion of the digits, thus permitting complete joint range of motion and full tendon excursion. These two factors are necessary for normal hand functioning.

Fourth, the prior art devices do not include means associated with the transverse portion of the exerciser that compensate for the different lengths of the fingers that grip the transverse portion. The middle and last two fingers have different lengths, therefore, it is necessary to provide a transverse portion of the exerciser that will accomodate and compensate for the differing lengths of these three fingers.

Finally, it is very important that the amount of resistance presented by the device be capable of being varied. It is especially important that this be easily accomplished with one hand during the early stages of hand rehabilatation. Such adjustments are difficult in the prior art devices.

SUMMARY OF THE INVENTION

It is an object of the present invention to provide an improved hand exerciser.

It is a further object of the present invention to provide an improved hand exerciser wherein the hand grip is contoured to maximize contact area between the palm of the hand and the hand grip.

It is a still further object of the invention to provide an improved hand exerciser wherein the transverse mechanism which is compressed by the hand is not only angled to conform to the hand so as to maximize its rehabilitative effect, but is also shaped to compensate for the different lengths of the fingers that grip the transverse portion and is rotatably mounted so as to permit complete flexion of the digits, complete joint range of motion and full tendon excursion.

It is another object of the present invention to provide an improved hand exercise apparatus wherein the stroke distance is easily varied so as to accommodate hands of different sizes.

Yet another object of the present invention is to provide an improved hand exerciser wherein the resistive force provided by the apparatus may be easily varied.

In accordance with one embodiment of this invention, a hand exerciser is provided having a frame with a contoured hand grip portion and a slide mechanism supported within the frame for reciprocative movement. The slide mechanism includes a transverse finger grip which is both rotatable and angled to maximize the contact area between the palm of the hand and the finger grip. Springs are positioned between the frame and the slide mechanism to provide the resistive force necessary. The resistive force may be adjusted by a single internally threaded unit which cooperates with an externally threaded fastening element between the frame and the slide mechanism. A mechanical counter is coupled to the frame and is engaged by the slide element for the purpose of counting the number of strokes. Also provided is a pointer and scale mechanism for indicating the amount of resistive force provided by the springs.

The above and other objects, features and advantages of the present invention will be more clearly understood from the following detailed description taken in conjunction with the acocmpanying drawings, in which:

BRIEF DESCRIPTION OF THE DRAWINGS

FIG. 1 is a perspective of the inventive hand exerciser apparatus;

FIGS. 3 and 4 are cross sectional views of the apparatus shown in FIG. 2 taken along lines 3 and 4 respectively;

FIG. 6 is a perspective view of the counting mechanism utilized by the inventive hand exerciser.

DESCRIPTION OF THE PREFERRED EMBODIMENT

Figure 2:
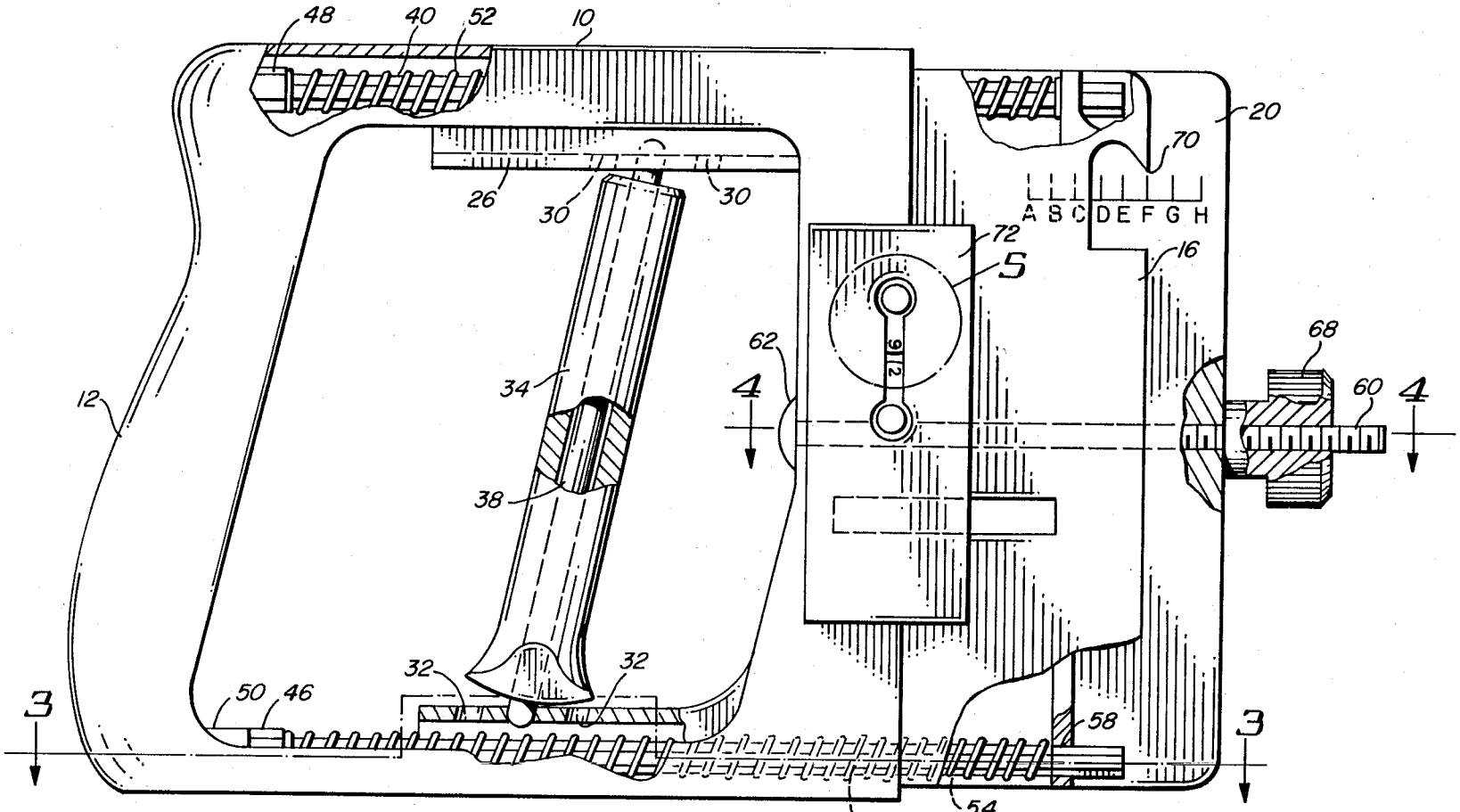
FIG. 2 is a side view of the exercise apparatus shown in FIG. 1.
Figure 5:
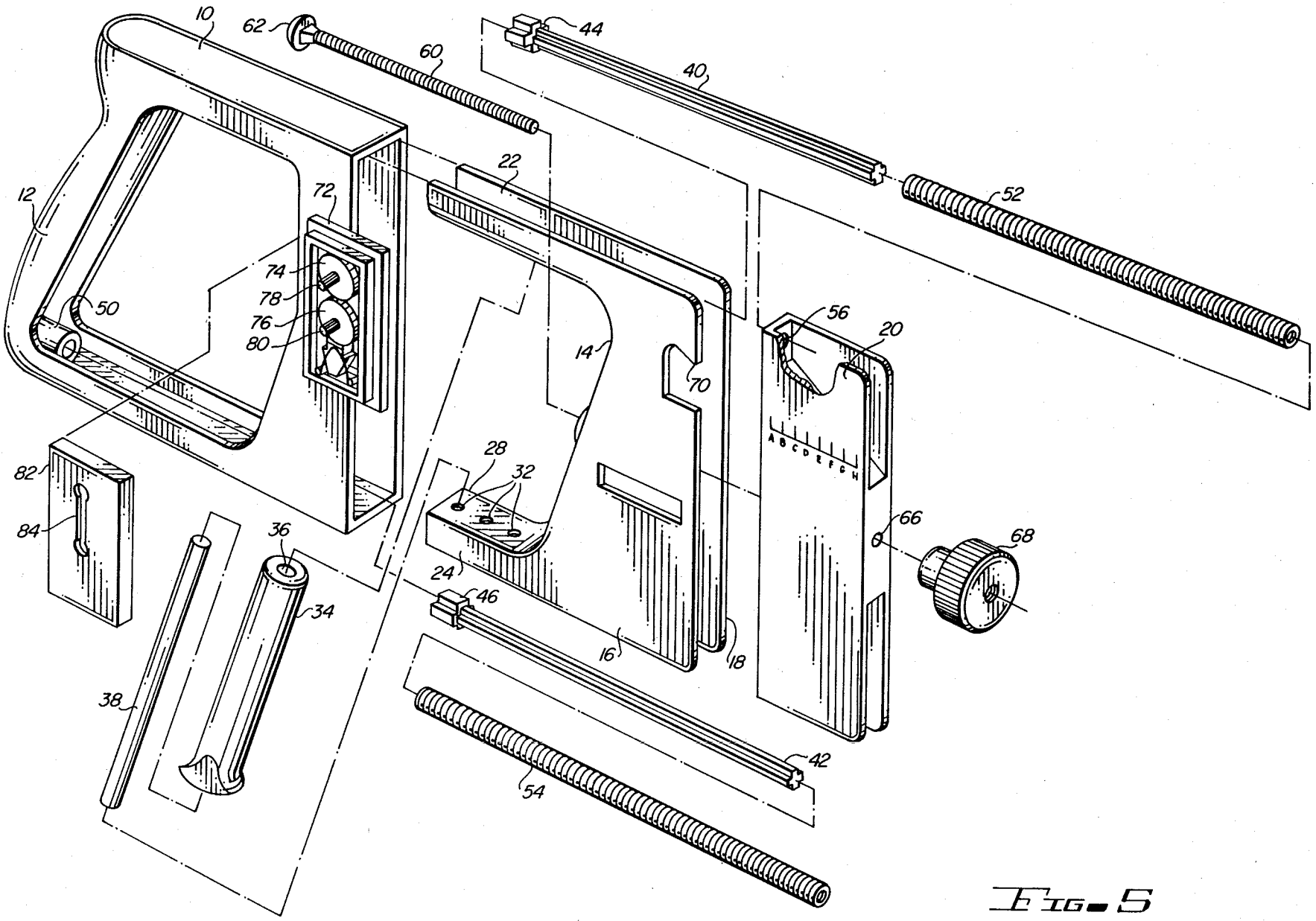
FIG. 5 is an exploded view of the exerciser apparatus shown in FIGS. 1–4.

Referring to FIGS. 1 to 6, the inventive hand exerciser comprises a generally rectangular and hollow frame or handle section 10 having a contoured convex hand grip portion 12, a channeled slide mechanism 14 having a first wall 16 and a second wall 18, and an insert assembly 20 having a width which permits it to be inserted between walls 16 and 18 of slide mechanism 14.

Upper and lower channel sections 22 and 24 of slide mechanism 14 are equipped with base sections 26 and 28 respectively each of which have a plurality of apertures 30 and 32 respectively therein. A transverse finger grip member 34 having a longitudinal bore 36 therethrough is positioned on mounting rod 38. The diameter of bore 36 is larger than the diameter of rod 38 so as to permit finger grip 34 to freely rotate on mounting rod 38. After finger grip 34 is positioned on mounting rod 38, the lower protruding end of rod 38 is positioned in one of the plurality of apertures 32 in slide mechanism 14. The upper protruding end of rod 38 is positioned in one of the apertures 30 in slide mechanism 14. By properly choosing which of apertures 30 and 32 mounting rod 38 is positioned in, the angle of transverse finger grip 34 can be varied so as to maximize the rehabilitated effect of the exerciser. Furthermore, the stroke distance of the device may be varied by choosing a different pair of apertures 30 and 32 which is closer to or farther from grip 12. Choosing the correct stroking distance and permitting transverse finger grip 34 to rotate provides for complete joint range of motion and full tendon excursion.

First and second spring mounting rods 40 and 42 each have first terminations 44 and 46 respectively which are inserted into and received by receiving cylinders 48 and 50, respectively which are fixedly coupled to or formed integrally with frame 10. Springs 52 and 54 (preferably compression springs where the desired compression depends on the selected thickness of the wire of the spring and the type of wire material) are inserted over spring mounting rods 40 and 42 respectively. The remaining ends of spring mounting rods 40 and 42 are then inserted through apertures 56 and 58 in a front portion of insert assembly 20.

An externally threaded fastening member 60 having a widened head portion 62 is then inserted through an aperture 64 in slide mechanism 14 and exits through an aperture 66 in insert assembly 20. An internally threaded adjusting knob 68 threadably engages that portion of fastening 60 which protrudes from aperture 66. Thus, the further knob 68 is threaded onto fastening 60, the more springs 52 and 54 will be compressed. Thus, the user will have to exert greater force to squeeze the transverse finger grip 34 and hand grip 12 towards each other. The effort required may be easily adjusted by turning adjusting knob 68 in an appropriate direction.

As can be seen, insert assembly 20 is provided with indicia thereon which cooperates with a pointed portion 70 on wall 16. Point 70 cooperates with the indicia on insert assembly 20 to serve as a measure of the amount of force that will be necessary to compress the exercise apparatus. A ratchet type mechanical counter assembly 72 is employed and coupled on frame 10 to serve as a measure of the number of times the exercise apparatus is compressed. As can be seen, counter 72 includes first and second ratchet wheels 74 and 76 respectively each of which may be accessed by knobs 78 and 80, respectively. A counter cover 82 is provided with a slotted opening therein through which knobs 78 and 80 will protrude to provide the user access. The counter assembly is shown in more detail in FIG. 6. Such ratchet type counter assemblies are well known and reference is made to U.S. Pat. Nos. 3,807,729 and 4,262,898.

As can be seen, the inventive hand exercise apparatus includes a contoured hand grip to increase contact between the grip and the palm of the hand being exercised. This, as stated previously, decreases the pressure in the thumb web space. Furthermore, transverse rod 38 may be angled to maximize the rehabilitative effect of the device. This transverse rod is preferably spaced on an angle of approximately 75 degrees. Transverse finger grip 34 is rotatably mounted on rod 38 to provide complete flexion of the digits, complete joint range of motion and full tendon excursion. Furthermore, the stroke distance of the device may be altered to accommodate hands of different sizes by simply choosing a different set of apertures 30 and 32 in which transverse finger grip 34 is mounted. Finally, the resistive force of the device may be easily adjusted with one hand by simply turning adjusting knob 68 and altering the degree of compression of springs 52 and 54.

The exercise apparatus described above is suitable for use by a patient from the beginning of resistive exercises, through the rehabilatative process, and can still serve as a valuable exercise device when recovery is complete. The level of resistance offered by the device can be simply varied via adjusting knob 68, and can have even a broader range by simply replacing springs 52 and 54 with springs having different compression rates. Counter 72 records the number of complete strokes that the patient performs which is very important to a patient following an exact prescribed force of treatment.

Figure 7:
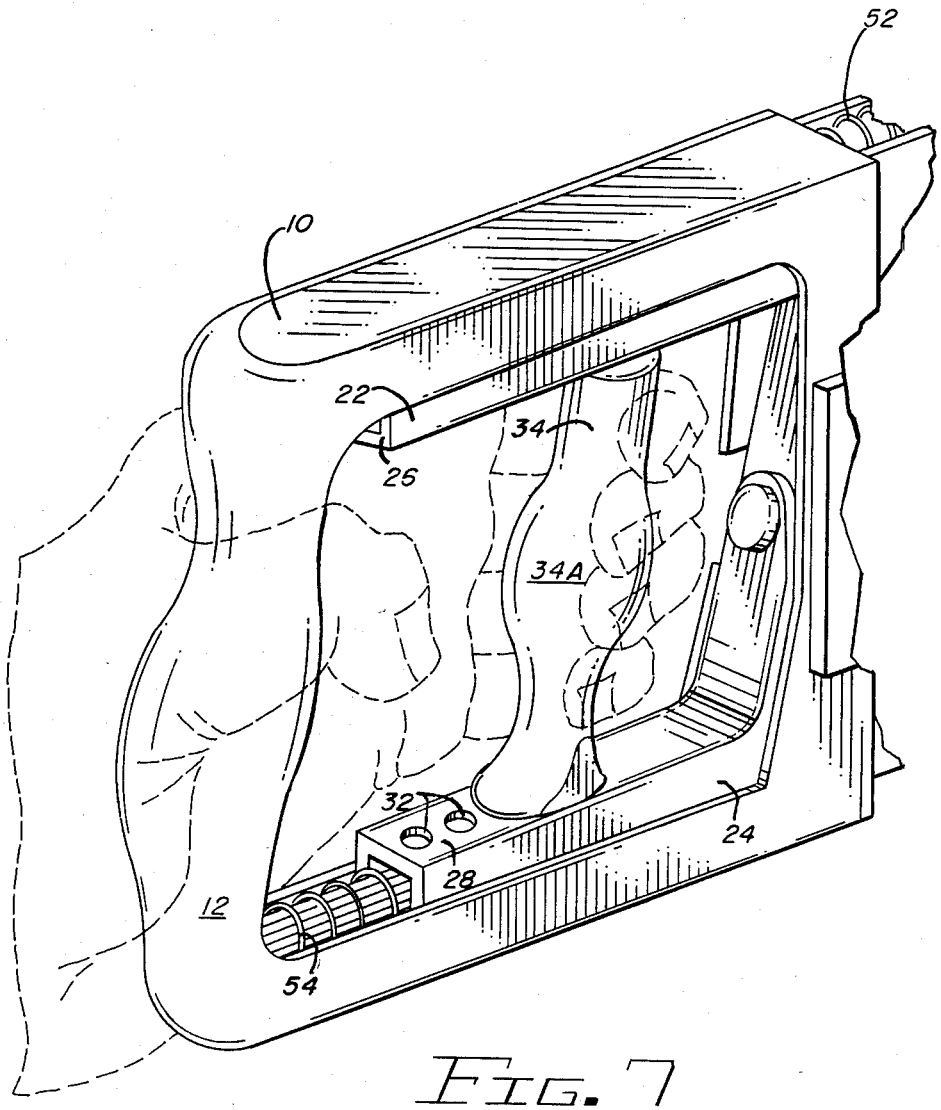
FIG. 7 is a view similar to FIG. 1 showing an improved transverse member which is conformed to compensate for the different lengths of the fingers that grip the transverse member.

Referring to FIG. 7 which is a view similar to FIG. 1, like reference numerals depict the same or corresponding parts of this preferred hand exerciser apparatus. The preferred hand exerciser embodiment of FIG. 7 is even more adaptable for use than the embodiment of FIG. 1 because of the unique contour or shape of transverse finger grip member 34A. As can be seen with reference to FIG. 7, transverse finger grip member 34A has a bulge portion which is an integral part of the transverse finger grip member 34A. The portion of the transverse finger grip member 34A is tapered inwardly from the bulge portion so that the different sizes of the middle and the last two fingers of a person's hand can be better fit or accomodated by means of the bulge portion for the longer middle finger and the inwardly tapered portion below the bulge portion for the gradually smaller sizes of the bottom or last two fingers. Thus, this hand exerciser apparatus of FIG. 7 is better anatomically than the embodiment of FIG. 1 and also provides a better fit, fill or skeletal match for the arch shape of the hand and the differing finger sizes.

The above description is given by way of example only. Changes in form and details may be made by one skilled in the art without departing from the scope of the invention as defined by the appended claims.

What is claimed is:

1. A hand exerciser, comprising:

a frame having a contoured hand grip portion;

a slide mechanism supported within said frame for reciprocative movement therein including a slide element for supporting a finger grip and an insert element, said insert element being slidably received by said slide element, said slide element including a first plurality of support means in a lower portion thereof and a second plurality of support means in an upper portion thereof, said finger grip being rotatable on a rod having the ends thereof positioned by any one of said first plurality of support means and any one of said second plurality of support means, said first and second pluralities of support means being aligned with the direction of reciprocation so as to enable a stroke distance between said contoured hand grip portion and said finger grip to be varied and depending upon what first and second support means are utilized to vary the angle of said finger grip portion with respect to said hand grip portion resilient means coupled between said frame and said slide mechanism for resisting movement between said frame and said slide mechanism and resisting the insertion of said insert element into said slide element; and adjusting means for varying the resistance of the resilient means between said frame and said slide mechanism including an adjustment element extending between said slide element and said insert element and means coupled to said adjustment element for manually adjusting the resistance of said resilient means.

2. A hand exerciser according to claim 1 wherein said finger grip comprises:

a grip element having a bore therethrough through which said rod passes and protrudes at both ends thereof, each protruding end for positioning in one of said first and second plurality of support means, said support means being apertures.

3. A hand exerciser according to claim 1 wherein said slide element has an indicating portion formed thereon for cooperating with a scale on said insert element to indicate the amount of resistance between said frame and said insert element imparted by said resilient means.

4. A hand exerciser according to claim 3 further comprising a counter coupled on said frame and engaged by said slide mechanism to count the number of strokes of said exerciser.

5. A hand exerciser according to claim 1 wherein said resilient means comprises at least one spring assembly each comprising:

a spring mounting rod having a first end fixedly coupled in said frame and a second end cooperating with said insert element; and a spring positioned on said spring mounting rod and compressed between said frame and said insert element.

6. A hand exerciser according to claim 5 wherein said resilient means comprises first and second spring assemblies.

7. A hand exerciser according to claim 6 wherein said spring is a compression spring.

8. A hand exerciser in accordance with claim 1 wherein said finger grip is provided with means for accommodating the differing sizes of the fingers of a person's hand so that said fingers will fit around and grip said finger grip.

9. A hand exerciser in accordance with claim 8 wherein said accommodating means comprising a bulge portion and inwardly tapered portions above and below said bulge portion to fit the differing sizes of the fingers of a person's hand.

* * * * *